US006052916A

United States Patent [19]

Tasoniero

[11] Patent Number: 6,052,916

[45] Date of Patent: Apr. 25, 2000

[54] AUTOMATIC PLANT FOR PRESSING AND UNLOADING ARTICLES OF CLOTHING

[76] Inventor: Sandro Tasoniero, 16 Via Valle, Terrossa Roncà, Italy, I-37030

[21] Appl. No.: 09/117,197

[22] PCT Filed: Jan. 23, 1997

[86] PCT No.: PCT/IT97/00015

§ 371 Date: Jul. 24, 1998

§ 102(e) Date: Jul. 24, 1998

[87] PCT Pub. No.: WO97/27355

PCT Pub. Date: Jul. 31, 1997

[30] Foreign Application Priority Data

Jan. 24, 1996 [IT] Italy ..... VR96A0007

[51] Int. Cl.[7] ..... F26B 25/00

[52] U.S. Cl. ..... 34/103; 34/106; 223/73

[58] Field of Search ..... 34/103, 104, 106, 34/621; 223/51, 70, 73

[56] References Cited

U.S. PATENT DOCUMENTS

| | | | |
|---|---|---|---|
| 2,290,040 | 10/1942 | Schwartz | 34/103 |
| 2,856,698 | 10/1958 | Kiel . | |
| 3,637,128 | 1/1972 | Blevens et al. | 223/73 |
| 3,719,311 | 3/1973 | Remiarz | 223/73 |
| 3,823,854 | 7/1974 | Everett | 223/73 |
| 3,892,047 | 7/1975 | Muller-Scherak | 34/103 |
| 4,473,961 | 10/1984 | Frushtick | 223/73 X |
| 5,361,516 | 11/1994 | Dahman | 34/106 X |
| 5,555,648 | 9/1996 | Griffin | 34/621 |
| 5,711,097 | 1/1998 | Mino | 223/73 X |

FOREIGN PATENT DOCUMENTS

| | | |
|---|---|---|
| 1158733 | 10/1956 | France . |
| 18 02 225 | 5/1970 | Germany . |
| 26 32 262 | 1/1978 | Germany . |
| 44 15 002 | 11/1995 | Germany . |
| 1 409 244 | 10/1975 | United Kingdom . |

*Primary Examiner*—Stephen Gravini
*Attorney, Agent, or Firm*—Oppenheimer, Wolff & Donnelly LLP

[57] ABSTRACT

An automatic plant (20) for pressing and unloading trousers (26, 27) using a plurality of machines (22, 23, 24, 25) for pressing said trousers by means of steam and/or hot air, each of which machines being provided with first means (10, 11) for blocking and unblocking an upper end of an article of clothing, and second means (12, 13) for blocking and unblocking lower ends of a same article of clothing, as well as with third means (15) for expelling and directing steam and/or hot air internally of said trousers when they are blocked by said first and second means. Said machines (22, 23, 24, 25) are mounted on a movable carousel continuously moving along a predetermined route, in such a way that said trousers (26, 27) are subjected to a pressing operation by means of steam and/or hot air for the whole period of time comprised from loading to the unloading operations of said trousers.

15 Claims, 2 Drawing Sheets

AUTOMATIC PLANT FOR PRESSING AND UNLOADING ARTICLES OF CLOTHING

TECHNICAL FIELD

Figure 1:
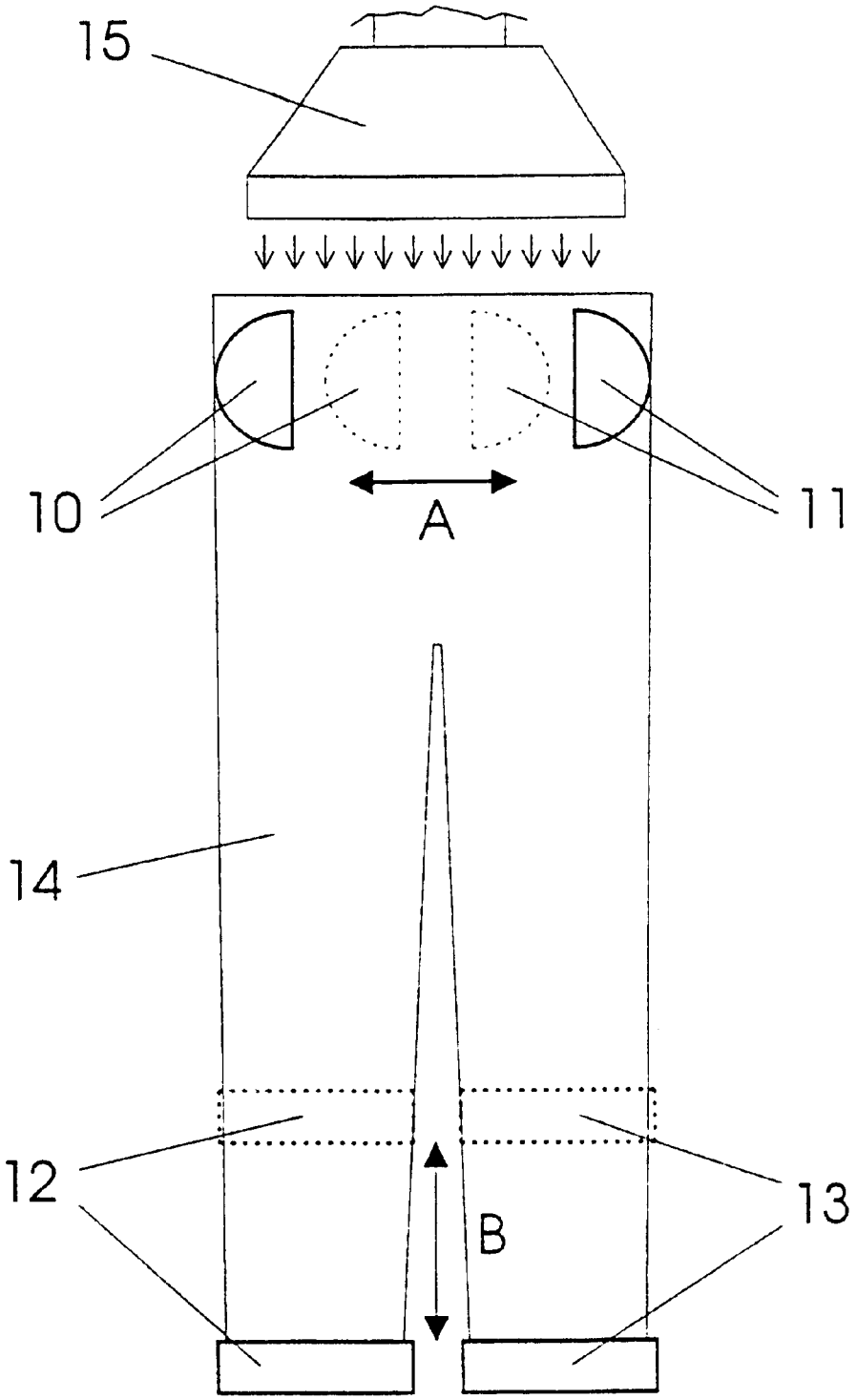

The invention relates to an automatic plant for pressing and unloading articles of clothing, specifically trousers.

More precisely, the present invention relates to an automatic plant which enables automatic pressing/ironing by the application of air and/or steam to a plurality of articles, such as trousers, continuously loaded on to the machine itself, and which then enables the trousers to be unloaded so that they can pass on to further operations.

The invention can be mainly applied in the field of industrial ironing-pressing machines.

BACKGROUND ART

The prior art teaches basically two types of machines for trouser pressing.

A first type of machine comprises a pair of hot plates between which the trousers to be pressed are inserted.

The pressing operation is carried out by combined application of pressure and heat.

A second type of ironing machine (see for instance DE-A-4,415,002) is of the type generally known as blown or ventilated ironing, or "Topper", and comprises a pair of movable shaped elements which translate following an electropneumatic command, and block, keep blocked and subsequently unblock within the belt area, a trouser positioned in correspondence of these elements by an operator.

This machine further comprises two pairs of plates, which are simultaneously movable in a vertical direction, each pair of plates fastening a lower end of a trouser by means of an elecotropneumatic command.

During operation, an operator first fixes the upper part of the trouser by using said shaped elements, thereafter he uses the plate pairs to fix the bottom ends of the trouser.

Subsequently the pairs of plates are vertically moved in such a way as to keep the trouser stretched. Then a jet of steam and/or hot air is directed into the trousers through the belt zone, which zone is kept open by the shaped elements. The inlet of hot air and/or steam is kept up for a determined time, directed by the operator, which time will be sufficient to press the trousers.

Finally, the operator switches off the electropneumatic commands, manually unloads the trouser, places it on a specially-provided working surface and loads a next pair of trousers.

Generally, the pressing times are between 15–18 seconds, which leads to an average production of about 800 trousers per day for each machine.

The above-described machines are normally utilised in pairs, with the aim of rationalising the pressing times and obtaining higher production.

In this case, a single operator acts on both machines, which work at staggered rhythms; for example, while one machine is pressing, the operator can load and/or unload the other machine.

A working cycle of this kind enables the production of about 1500–1700 pressed trousers per day per operator, based on the average pressing time of 15 seconds per trouser.

For obvious reasons connected with production, machines of this type are programmed to carry out the pressing in the shortest time possible, compatibly with the obtaining of a given quality of pressing. It has been found that about 15 seconds does not provide a high-quality pressing, which is obtained only with times higher than 22 seconds per trouser; however, such long times are incompatible with the production rhythms required by modern industrial pressing/ironing companies.

Further, each pair of the above-described pressing machines requires the presence of a fixed operator, leading to considerable production costs.

DE-A-1,802,225 discloses an automatic pressing/ironing machine constituted by a rotating carousel on which is mounted a plurality of stretched dummies suitable for supporting corresponding shaped articles of clothing such as skirts, dresses and the like. Moreover, a suitable device is provided in order to introduce steam, and successively hot air, into said dummies while the dummies are stopped at predetermined working stations.

FR-A-1,158,733 discloses an automatic plant which is constituted by a rotating carousel composed by a plurality of dummies which are intermittenly moved passing through predetermined stations where steam and hot air are supplied.

GB-A-1,409,244 discloses an automatic plant that is provided with a plurality of bucks on which the garments are mounted and indexed to and from a number of stations at which different operations are performed.

The automatic plant also presents an automatic unloading device which is constituted by a suitable arm, operated by a piston and cylinder arrangement, the free end of said arm being provided with a nose so as it can engage the hanger placed inside of the buck.

DESCRIPTION OF THE INVENTION

The present invention aims to provide a solution to the above-described problems by providing an automatic pressing machine for ironing and pressing of trousers which allows high production levels to be achieved, as well as reducing the number of operators dedicated to the machines, and thus also reducing production costs.

This result is obtained with an automatic plant for pressing trousers having the features described in the main claim.

The dependent claims describe further advantageous embodiments of the invention.

The automatic machine according to the present invention comprises a rotating carousel on which are located a plurality of machines for pressing trousers by means of the application of steam and/or hot air, said machines being arranged on the carousel at predetermined and, advantageously, equal angular distances.

The plant comprises a first loading station, at which an operator loads a trouser on the machine which is temporarily present at said first station.

During the course of the carousel's motion, the pressing machine which is coming out of the first loading station carries out the pressing operation in a conventional way, for a predetermined time span.

The machine then arrives at a second station, for unloading, at which a preferably automatic unloading device is present.

This unloading device is formed by a suction head which is automatically disposed at the position of the trouser to be unloaded at the instant when the trouser unblocking elements are opened.

Consequently, the trouser is loaded by the suction head, which distances the trouser from the machine and deposits it on a plane which is advantageously constituted by a special conveyor.

In the meantime, the machine, which has been unloaded of the trouser, is brought back to the first loading station to start a new cycle.

A careful choice of carousel rotation times leads to obtaining a plurality of advantages, thus attaining the aims of the invention.

The whole plant, composed of a number of machines, can be managed by a single operator whose only task is to load the trousers on the machine, as the unloading is completely automatic.

Further, high productivity and relatively long pressing times can be obtained, giving a high-quality finished product.

ILLUSTRATION OF DRAWINGS

Figure 2:
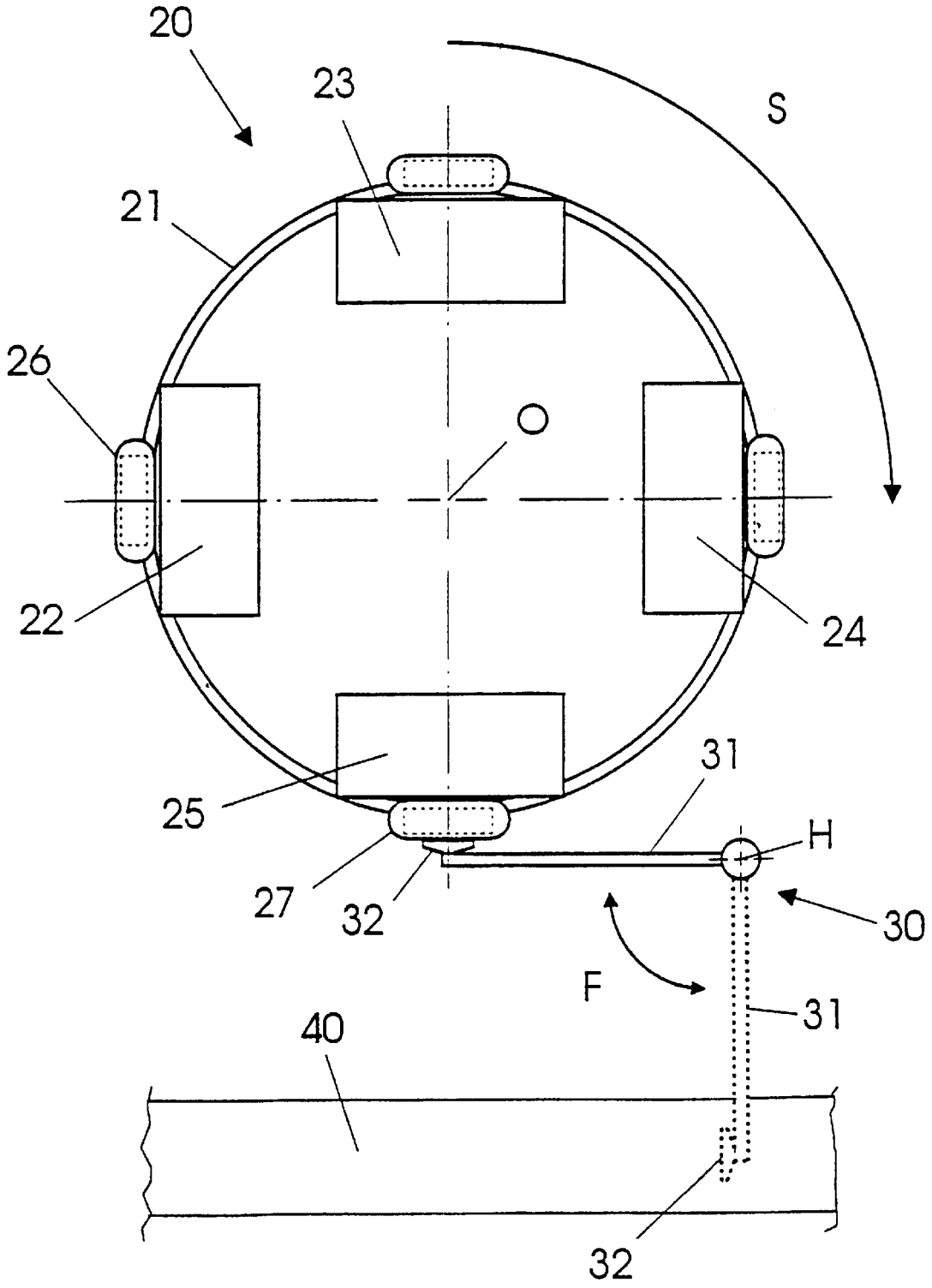

Further features and advantages of the invention will better emerge from the detailed description that follows, provided as a non-limiting example together with the annexed drawings, in which:

FIG. 1 schematically shows the work process of a steam and/or hot air machine for trouser pressing of a conventional type;

FIG. 2 is a schematic representation of a trouser pressing plant according to the present invention, in this case provided with four pressing machines of the type illustrated in FIG. 1.

DESCRIPTION OF A FORM OF EMBODIMENT.

In FIG. 1, a conventional machine for steam and/or hot air pressing of trousers comprises a pair of shaped elements 10, 11, which are simultaneously movable by means of a special electropneumatic command, from a first position (shown in broken lines) in which the elements 10, 11 are drawn near, and a second position (shown in continuous lines) in which the elements 10, 11 are driven away.

The movements carried out by the elements 10, 11 are indicated in FIG. 1 by means of arrows A, which are in fact two endrun positions, at the first of which a trouser 14 can be inserted from below externally of the elements 10, 11, while at the second of which the trouser is gripped by the dividing force of the elements 10, 11 themselves.

The machine further comprises two pairs of plates 12, 13, which are parallel (only the first of the plates is visible in FIG. 1).

Each of the pair of plates 12, 13, is arranged such that a front plate can be drawn near and driven away from a back plate, with the aim of enabling an end of a trouser 14 to be inserted and subsequently blocked there by means of an electropneumatic command.

Further, the two pairs of plates 12, 13, are provided with a vertical raising and lowering movement, also controllable by means of an electropneumatic command, with the aim of keeping the trouser vertically stretched once its ends have been respectively inserted and blocked between the pairs of plates 12, 13.

The vertical raising and lowering movements of the plates 12, 13, is indicated in FIG. 1 by arrows B.

Finally, the machine comprises a device 15 for introducing into the trouser 14, when blocked by the elements 10, 11 and the plates 12, 13, a jet of steam and,or hot air at predetermined temperatures and pressures, for a period of time which is also predetermined and sufficient for obtaining a pressing of the material constituting the trouser 14.

A machine of this type is well known in the prior art and is not part of the present invention.

In FIG. 2, a plant 20 for automatic steam and/or hot pressing of trousers comprises a rotating carousel constituted by a circular metal frame 21 for supporting a plurality of pressing machines 22, 23, 24, 25 of the type illustrated in FIG. 1 and described hereinabove, said machines being individually connected to a centralised system (not illustrated) for steam production, or hot or compressed air production.

The circular metal frame 21 is connected to special means (not shown in the figures) for rotating the frame 21 itself about its axis 0.

For this purpose, for example, the frame 21 can be arranged on special turntables or bearings which are connected, for example, by a belt, to a driving device constituted by an electric step motor and a possible gear reducer; an electronic control device drives the frame 21 in rotation at an exactly-predetermined angular speed in the direction indicated by arrow S in the figure.

We consider now the machine 21, which placed at the loading station of the trousers 26.

An operator, acting at said loading station, loads a trouser 26 on to the machine 22 during the rotation movement of frame 21 about axis 0, following the same modalities as described with reference to FIG. 1.

Once the loading has been carried out, the steam and/or hot air is immediately injected into the inner part of trouser 26, and trouser 26 is subjected thereto for a predetermined period of time, for example 24 seconds, until it reaches the unloading position as indicated in FIG. 2 by the position of the machine 25.

At this point the steam and/or hot air is shut off and the trouser 26 is removed from the machine by a second operator, or, advantageously, by means of an automatic device 30 which will be described in more detail hereinbelow.

The above-described process is continuously repeated for each machine on the frame 21. In this context it is worthwhile noting that FIG. 2 represents a plant equipped with four machines 22, 23, 24, 25; however, the number of machines does not constitute a limitation of the present invention, which is applicable to any number of machines.

Also noteworthy is the fact that the invention is not limited to a plant assembled on a circular frame; preferred embodiments include those having single machines mounted on movable supports moving along tracks following a predetermined route, not necessarily circular.

According to the invention, the plant 20 is provided with an automatic unloading device 30 for the pressed trousers, arranged at an unloading station identified in FIG. 2 as the position at which the machine 25 is temporarily halted.

The device 30 is essentially constituted by an arm 31 oscillating between two endrun positions indicated respectively in continuous and broken lines, the oscillating motion being produced by a special motor (not shown in the figure) vertically about an axis H and in the direction indicated by arrow F.

The free end of the arm 31 is provided with a suction head 32 connected to means for creating suction, for example a vacuum pump, controllable by means of the electronic plant command device 20.

In operation, the arm 31 is moved in such a way that the head 32 comes into the vicinity of the pressed trouser 27 at the moment of passage of the machine 25 into the unloading station.

The suction head 32 is activated coordinatedly with the unblocking of the trouser by the plates and the shaped elements on the machine 25, and the trouser is loaded by the suction head 32 itself; the oscillating arm is thus caused to oscillate towards the second endrun position and, having reached this position, the aspiration is interrupted.

Consequently, the trouser 27 falls on a surface 40 which is advantageously constituted by a conveyor which transports the trouser towards other working stations, for example a stocking station.

The oscillating arm then oscillates once more, collecting the next pressed trouser produced by the rotary movement of the frame 21 at the unloading station.

The main electronic command device obviously coordinates and synchronises the respective rotation speeds of the frame 21 and the arm 31 oscillation.

A plant 20 of the above-described type affords a plurality of advantages.

Indeed, tests carried out by the applicant have shown that it is possible, for example with a plant constituted by four machines such as the above-described, to manage the whole plant with a single operator for loading trousers, thus reducing the overall costs.

Further, in a plant of this type the pressing times can be kept relatively high, for example 24 seconds between loading and unloading, thus obtaining a very high pressing quality while maintaining daily productivity at about 3200 trousers. This number substantially corresponds to the same number of trousers obtainable with four traditional machines, for which two operators are necessary and which offers a pressing time of only 15 seconds.

If pressing quality is somewhat sacrificed, bringing down pressing times to 15 seconds, and consequently increasing the speed of the carousel, the plant of the invention offers very high production rates, unthinkable with traditional processes.

What is claimed is:

1. An automatic plant for pressing and unloading trousers, using a plurality of machines for pressing said trousers by means of steam and/or hot air, each machine being provided with first means for blocking and unblocking an upper end of said trousers, and second means for blocking and unblocking lower ends of the same trousers, as well as with third means for expelling and directing steam and/or hot air internally of said trousers when said trousers are blocked by said first and second means, wherein said machines are mounted on a movable carousel continuously or intermittently moving along a predetermined path, in such a way that said trousers are subjected to a pressing operation by means of steam and/or hot air for substantially the whole period of time comprised from loading to the unloading operations of said trousers.

2. A plant according to claim 1, wherein said movable carousel is provided with a movable support frame able to rotate about an axis thereof driven by a motor at an angular speed which is predetermined and electronically controllable.

3. A plant according to claim 2, wherein said motor is constituted by an electric motor and possibly includes a gear reducer.

4. A plant according to claim 1, further comprising means for automatically unloading single trousers once said trousers arrive, during a rotation motion of said carousel, at said unloading station.

5. A plant according to claim 4, wherein said means for unloading comprise an arm oscillating between a first position for gripping trousers and a second position for unloading trousers, said arm being driven by a motor which is electronically controlled and being provided with a suction head connected to means for aspiration which are electronically controlled.

6. A plant according to claim 4, wherein the respective rotation speeds of the carousel and of the arm are coordinated and synchronised by means of an electronic control panel.

7. A plant according to claim 4, further comprising a conveyor for collecting and transporting the unloaded trousers from said automatic unloading device.

8. An automatic plant for pressing and unloading trousers, using a plurality of machines for pressing said trousers by means of steam and/or hot air, each machine being provided with first means for blocking and unblocking an upper end of said trousers, and second means for blocking and unblocking lower ends of the same trousers, as well as with third means for expelling and directing steam and/or hot air internally of said trousers when said trousers are blocked by said first and second means, wherein said machines are mounted on a movable carousel continuously or intermittently moving along a predetermined path, in such a way that said trousers are subjected to a pressing operation by means of steam and/or hot air for substantially the whole period of time comprised from loading to the unloading operations of said trousers, and including a centralized system for steam or compressed air during substantially the whole pressing cycle.

9. A plant according to claim 8, wherein said movable carousel is provided with a movable support frame able to rotate about an axis thereof driven by a motor at an angular speed which is predetermined and electronically controllable.

10. A plant according to claim 9, wherein said motor is constituted by an electric motor and possibly includes a gear reducer.

11. A plant according to claim 8, further comprising means for automatically unloading single trousers once said trousers arrive, during a rotation motion of said carousel, at said unloading station.

12. A plant according to claim 11, wherein said means for unloading comprises an arm oscillating between a first position for gripping trousers and a second position for unloading trousers, said arm being driven by a motor which is electronically controlled and being provided with a suction head connected to means for aspiration which are electronically controlled.

13. A plant according to claim 11, wherein the respective rotation speeds of the carousel and of the arm are coordinated and synchronised by means of an electronic control panel.

14. A plant according to claim 11, further comprising a conveyor for collecting and transporting the unloaded trousers from said automatic unloading device.

15. An automatic plant for pressing and unloading trousers, using a plurality of machines for pressing said trousers by means of steam and/or hot air, each machine being provided with first means for blocking and unblocking an upper end of said trousers, and second means for blocking and unblocking lower ends of the same trousers, as well as with third means for expelling and directing steam and/or hot air internally of said trousers when said trousers are blocked by said first and second means, wherein said machines are mounted on a movable carousel continuously or intermittently moving along a predetermined path, in such a way that said trousers are subjected to a pressing operation by means of steam and/or hot air, and including a centralized system for steam or hot air or compressed air production and providing each machine with steam or hot air or compressed air during substantially the whole processing cycle.

* * * * *